United States Patent [19]

Savor et al.

[11] 4,193,735

[45] Mar. 18, 1980

[54] WORK TABLE FOR A STEPPED PLATFORM

[75] Inventors: Dennis E. Savor, Hixson; James W. Hales, Harrison, both of Tenn.

[73] Assignee: Combustion Engineering, Inc., Windsor, Conn.

[21] Appl. No.: 899,447

[22] Filed: Apr. 24, 1978

[51] Int. Cl.[2] ..... F28G 15/04

[52] U.S. Cl. ..... 414/744; 165/76; 414/750

[58] Field of Search ..... 214/1 CM, 1 BB, 1 BC; 165/76

[56] References Cited

U.S. PATENT DOCUMENTS

| | | | |
|---|---|---|---|
| 3,889,820 | 6/1975 | Ranger | 214/1 CM X |
| 3,913,752 | 10/1975 | Ward | 214/1 CM X |
| 4,018,346 | 4/1977 | Leshem | 214/1 CM X |

*Primary Examiner*—Trygve M. Blix
*Assistant Examiner*—George F. Abraham
*Attorney, Agent, or Firm*—Arthur L. Wade

[57] ABSTRACT

A stepped platform is arranged to traverse the down-facing tubesheet of a nuclear steam generator with a rotating, circular work table attached to the platform to position a plurality of tools, in sequence, at a common area of the tubesheet for required work.

3 Claims, 5 Drawing Figures

WORK TABLE FOR A STEPPED PLATFORM

BACKGROUND OF THE INVENTION

The invention relates to a work platform which is traversed over a downwardly facing surface. More particularly, the invention is in the structure, attached to a work platform with which to carry out work at predetermined areas in a predetermined sequence.

The development of the traversing mechanism for work platforms clinging to the underside of a horizontal surface began as evidenced by U.S. Pat. No. 3,913,752 issued Oct. 21, 1975 to Ward et al. U.S. Pat. Nos. 3,913,452 and 3,889,820 issued with identical specifications. Improvements formed the basis for U.S. Pat. Nos. 4,018,344, 4,018,345 and 4,018,346 which issued with identical specifications.

Although the traversing mechanism is now developed into a relatively trouble-free device, mounting tools on the traversing mechanism to carry out various types of work in a predetermined sequence has not been developed. The work contemplated in the U.S. Pat. Nos. 4,018,344/4,018,345/4,018,346 disclosure was quite limited. In that specification probe tubes 79 are mounted on plates 62. The probe tubes 79 receive eddy current probes for the inspection of tubes of a steam generator.

The probes in tubes 79 perform valid work. They are carried into position by the platform on which they are mounted. However, there is no flexibility in the disclosure when more than one operation is to be carried out at a single position of the platform. Not only is it required to inspect tubes in a steam generator, but it is now required to plug those found to be defective. The plugging operation can involve several different tools and the prior art does not disclose how the tools can be mounted on the platform and brought sequentially to a common work area.

STATEMENT OF THE INVENTION

The present invention contemplates a work table mounted on a surface traversing mechanism and movable in bringing various tools to a common location on the surface, the tools then operated effectively at the location.

The invention further contemplates the work table in the form of a circular flange mounted on the traversing mechanism and rotated to bring various tools on the flange to the common location.

It is also contemplated that linking members are mounted on the work table to be selectively extended to engage the surface to stabilize the flange and tools during their work period.

Other objects, advantages and features of the invention will become apparent to one skilled in the art upon consideration of the written specification, appended claims, and accompanying drawings.

DESCRIPTION OF THE PREFERRED EMBODIMENT INCORPORATED DISCLOSURE

Figure 1:
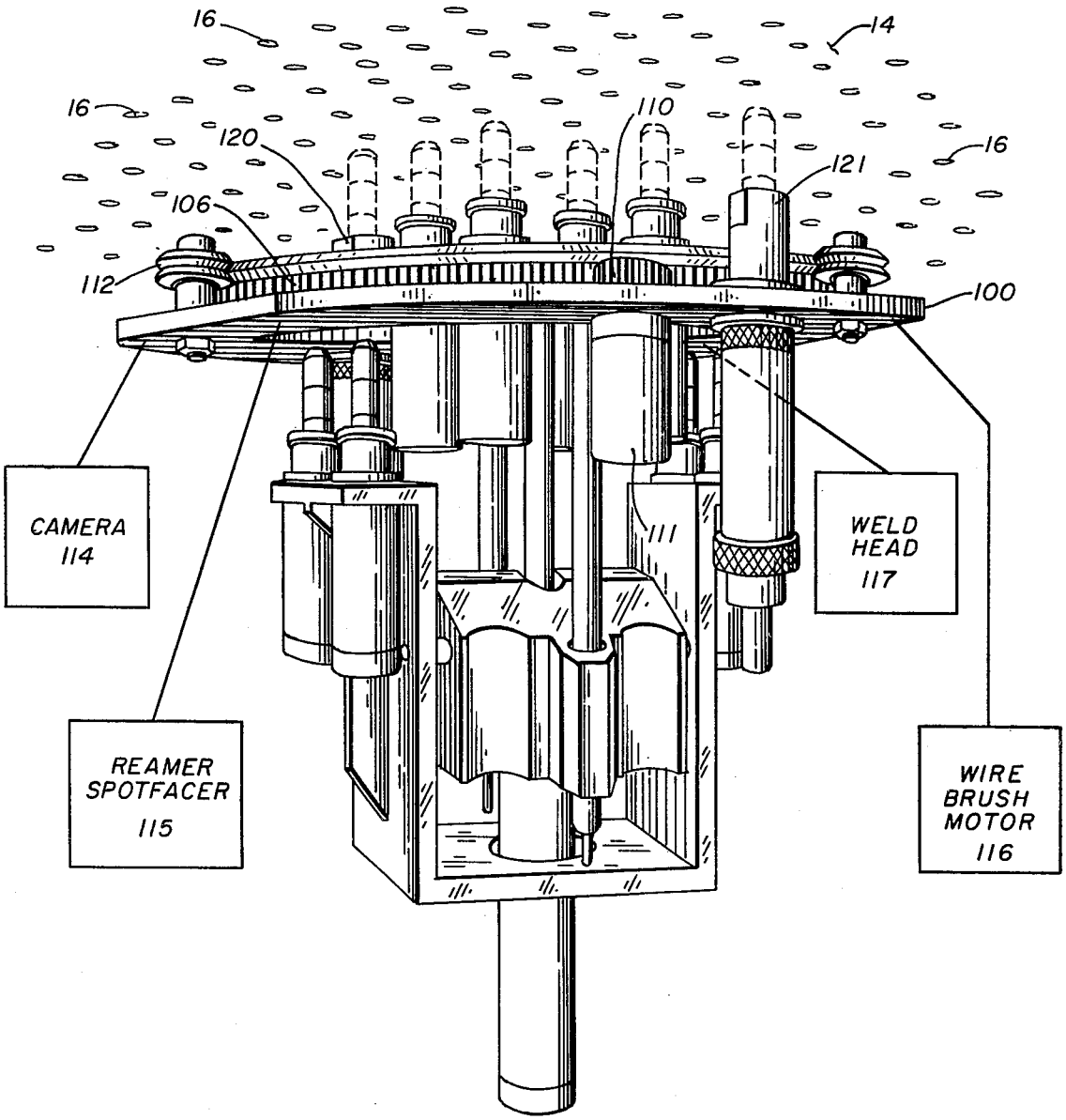
FIG. 1 is a perspective view of a surface traversing apparatus operatively positioned on the underside of a tubesheet and including the invention.

The general plan of the drawing disclosure depends heavily upon the elaborate, excellent disclosure of U.S. Pat. Nos. 4,018,344 and 4,018,345 and 4,018,346. Relative to the traversing mechanism, its general form and step actuation, the disclosure of these patents is incorporated and made a part of this application.

Platform 10 is composed of a pair of interconnected slide assemblies. On each slide assembly, expansible fingers are mounted.

In FIG. 1, platform 10 is shown as positioned closely beneath horizontal tubesheet 14 located in a nuclear steam generator. The fingers, on the slide assemblies, are vertically extended into the tubes 16 attached through tubesheet 14. The lower ends of the tubes are joined to the tubesheet by substantially circular weld heads.

As very elaborately disclosed in the incorporated disclosure, each finger is selectively expandable to grip the internal wall of a tube 16 when inserted into the tube. The fingers on each slide assembly are actuated together to grip and release tubes 16. The slide assemblies are moved, relative to each other, as their fingers alternately grip and release tubes 16. The result is a step-by-step traverse, by the platform 10, of the surface of tubesheet 14.

Each slide assembly is structured about a base. Both bases 22 and 23 are generally rectangular in plan view. Two finger mounting plates 62 are associated with base 22. Two finger mounting plates 76 are associated with base 23. In the incorporated disclosure, plates 62 form a mount for probe tubes 79. The probe tubes 79 may receive eddy current probes, or the like, from outside the steam generator. The present invention includes the concept of replacing plates 12 with a plate which will provide a race for a worktable on which are mounted tools to be positioned over certain tubes requiring inspection and service.

PRESENT DISCLOSURE

In FIG. 1 of the present application, a tubesheet of a nuclear steam generator is disclosed as was represented in the disclosures of the incorporated patents. The platform is also generally designated 10, its fingers extended upwardly into tubes 16 of tubesheet 14. This common denominator of disclosure serves to key the incorporated disclosure to the structure in which the present invention is embodied.

The present embodiment centers about rotary work table 100 which is in the form of a circular flange mounted with its center in substantial vertical alignment with the geometrical center of the base of platform 10. It will be made clear with subsequent views how various tools are mounted on table 100. Further, it will be disclosed in detail how the table 100 is rotated to bring its tools into register with each tube 16 inspected and serviced.

Figure 2:
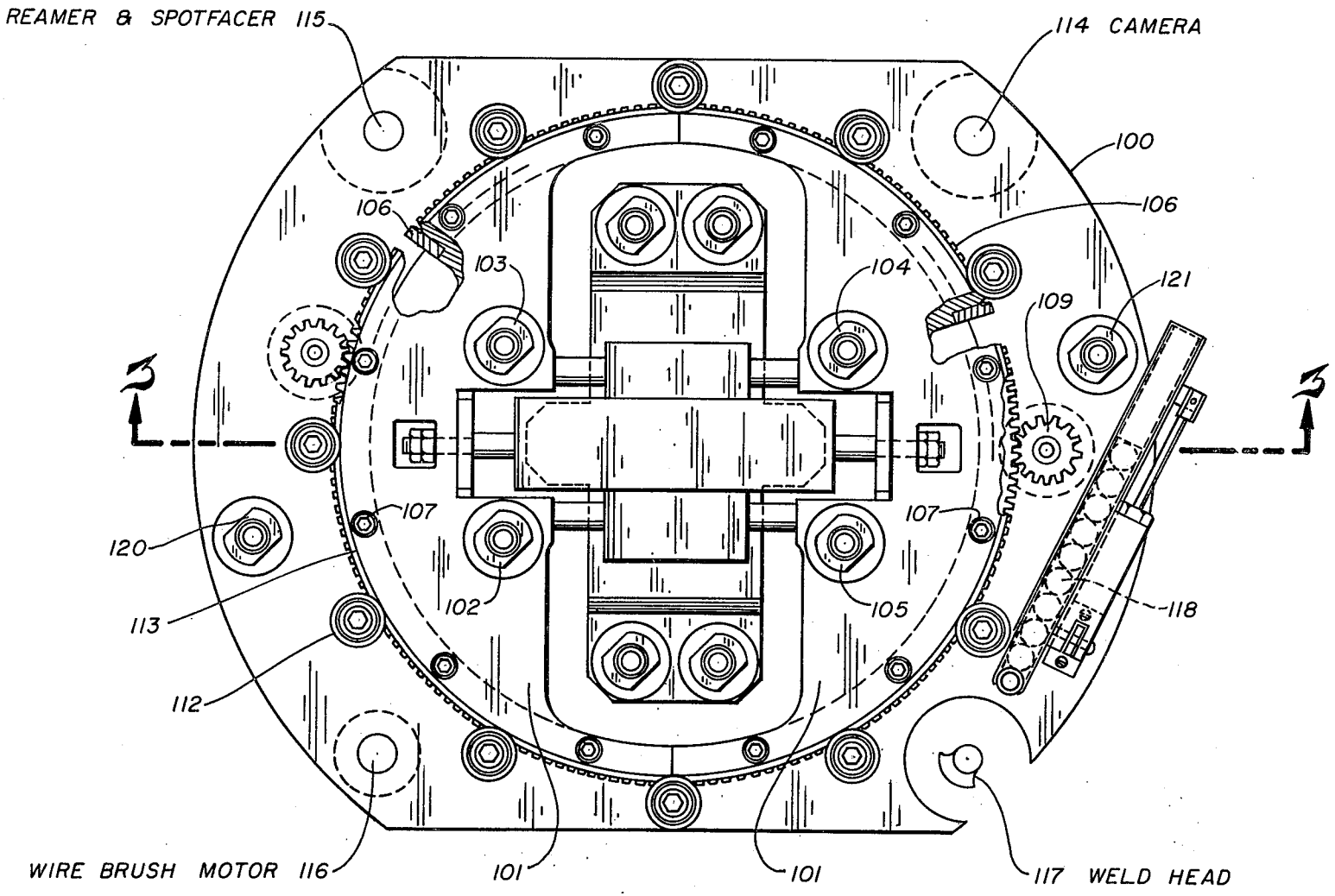
FIG. 2 is a bottom view of the surface traversing apparatus of FIG. 1.

FIG. 2 is a plan view to disclose specifically how table 100 encircles platform 10 which forms the mount for the table. Table 100 is connected to platform 10 through race plates 101. It is these race plates 101 which may be regarded as replacements for plates 62 of the incorporated disclosure.

Once it is clear that there is a fixed, determinable, controllable relation extending from table 100 to bases 22 and 23, it is also clear that platform 10 can be actuated to place table 100 at any desired special relation to any tube 16 to which the platform has access. It follows that the tools mounted on table 100 can be sequentially indexed to a common position to perform work on selected tubes 16. The system which controls the fingers, and bases 22 and 23, can obviously be applied to position the table, and its tools, as desired, over the face of tubesheet 14. It is now evident that the work performed from the platform is greatly extended beyond the work that could be performed by the structure of the incorporated disclosure.

SCOPE OF WORK POSSIBLE WITH TABLE 100

The plugging of tubes in nuclear steam generators has proven to be very expensive. When leaks are discovered during normal operation, the particular utility must be shut down for the duration of the repair procedure. At present, these repairs are made manually by the welders placing a plug body into the tube hole and welding the plug in place with a handheld torch using the "TIG" process. The person doing the welding must crawl through a 16" diameter manway in order to gain access to primary side of the tubesheet where the plugging must be done. The interior of the generator where work is performed is highly radioactive, therefore, health physics personnel must be present to monitor the level and time of exposure for every individual who enters the contaminated zone. When each operation must be done manually, a great deal of man-rem exposure time is accumulated. The expense of exposing many people to do normally a small task, coupled with the uncertainty of health hazards associated with radiation exposure time, has placed a high priority on the development of remote controlled devices that will alleviate the need for exposure of personnel to radiation fields.

The work contemplated for the platform 10 in the incorporated disclosure avoids the accumulation of a great deal of MAN-REM exposure time. The present invention contemplates a greatly expanded scope of work, as exemplified in connection with tube plugging. A series of work operations, and observations, can be carried out at each selected tube location.

Taking one more specific step, the tube plugging operation example requires the use of four tools mounted on the work table:

1. Camera (closed circuit TV with monitor outside of generator)
2. A tube hole reamer and spotfacer
3. A wire brush
4. A weld head and tube plug injector The table is rotated to bring its tools into register with a particular tube 16 by a gear motor attached to the table and driving a pinion between the table and its race. A position monitor is driven from the ring gear of the race. Multiple locking and securing fingers on the table are extended into holes on the tubesheet to form additional linkage between the table and the work piece to doubly assure alignment and alleviate vibrations while the tools are in operation.

CONNECTION BETWEEN WORK TABLE AND RACE PLATES

Figure 3:
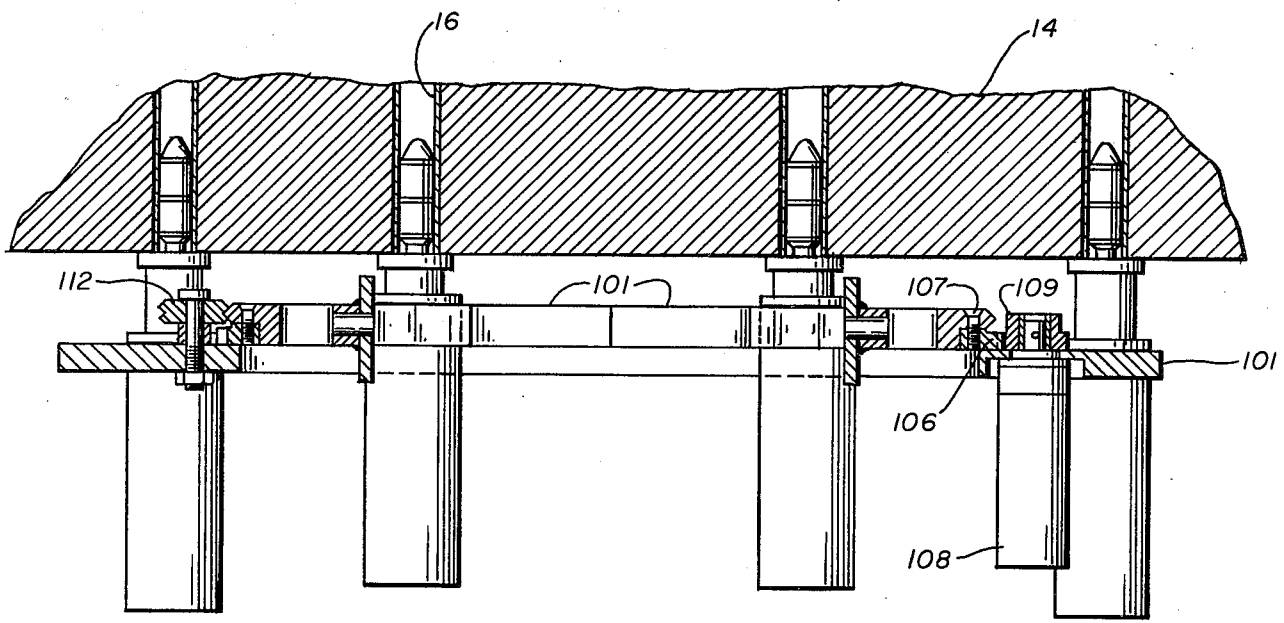
FIG. 3 is a partially sectioned front elevation of the apparatus of FIG. 2, along lines 3—3.

FIG. 3 is to be correlated with the preceding FIGS. for full disclosure of the form and arrangement of work table 100 and race plates 101, together with the platform 10 and tools mounted on the table. Race plates 101 can be analyzed in two parts, as were finger mounting plates 62 of the incorporated disclosure. In a more realistic view, race plates 101 are connected in a single, unitary piece. Four fingers are mounted at the positions 102,103,104, and 105 on this race plate 101 and a ring gear 106 is bolted to the circular, outer, edge of the race plate with bolts 107.

Drive motor 108 is mounted beneath table 100 and its drive shaft extends vertically upward for attachment to pinion gear 109. Gear 109 and ring gear 106 mesh. Therefore, actuation of motor 108 results in rotation of table 100 about gear 106. Also, a transducer pinion gear 110 is meshed with ring gear 106 to provide read-out in angular position of table 100 movement via potentiometer 111. V-guide wheels 112 are attached to table 100 and mate with the V-projection from the rim 113 of the race. With this arrangement, the table is held positively about the platform 10 and is rotated to desired positions by actuation of motor 108.

CLAIM SCOPE

The invention disclosed is closely associated with the surface traversing apparatus which is generally designated 10. It is possible, of course, to use the platform 10 on a flat surface which faces upward or at an angle to the horizontal. However, the platform was initially developed to traverse the surface of a tubesheet which faces downward. This orientation is shown in FIG. 1.

Considering the platform as a unit, the invention is in the structure hung on the unit. More specifically, the invention is in a circular race mounted on the base of the platform with its center in substantially vertical alignment with the geometrical center of the base.

The race is in the form of a plate, its outer edge shaped to function as the contact surface which specifically engages and supports a work table which is in the form of a circular flange. The table, as a flange, is concentric of the race. Engaged in rolling contact, the race plate becomes a base for the table which is rotated about the race and the platform.

The rolling contact is carried out with a plurality of guide wheels spaced at fixed positions between the race and table. The wheels are attached to the table and engage the edge of the race in the rolling contact. It is, of course, possible to mount the wheels on the race and bring the inner table edge into rolling contact with the wheels. In view of the scope of the invention, the wheel locations are immaterial as long as they provide the rolling contact as the table rotates in a plane parallel the surface traversed by the platform.

The rotation of the table is powered by a motor 108. A gear is provided between the race and table. With the gear meshing with the ring gear on the race, and the motor mounted on the table, the table is rotated when the motor turns the gear. In this way the table is rotated to selected positions relative to the surface which is traversed by the platform. This position or rotation of the table is monitored by the transducer potentiometer 111 which is meshed with the ring gear on the race in the same manner as is the drive motor.

All that remains to structurally complete the broad embodiment of the invention is to mount a plurality of tools at locations on the work table. With each tool at a specified location, a like number of operations can be performed in sequence at each work area available to the platform as it traverses the surface.

The platform is broadly defined in its structure for stepwise movement over the traversed surface. The race, table, wheels, motor and tools are attached to the platform in a broad sense to carry out work required at selected areas of the traversed surface. The scope of the claim to novelty is therefore broadly, but logically, drawn about these interacting structural elements.

TOOL LOCATION ON WORK TABLE

Having disclosed how work table 100 is mounted on platform 10 and rotated on the mounting, there next arrives the complication of disclosing tools mounted on the table. Showing only the essential outline of the platform 10 makes a complex drawing as shown in FIG. 1. The rotary table 100 complicates FIG. 1 further. To show even the outlines of tools mounted on table 100 would result in far more clutter than would be reasonable.

The convention decided upon, for the tools, in FIG. 1 is to indicate each of four tools by blocks. Then an arrow to the tool location on the table 100 will give a fair representation of the structure in which the invention is embodied.

Specifically, a television camera 114, a reaming and spot facing tool 115, a wire brush 116 and a weldhead 117 have their positions indicated. Each device is, in turn, positioned at a tube 16. The center point of all tools used on the table 100 are equally spaced on a common circle whose radius from center of rotation coincides with the center of a tube hole.

STABILITY OF THE WORK TABLE

Circular work table 100 is formed from a sturdy piece of metal plate which is a secure base for the various tools supported by the platform 10. The table and platform are connected, through wheels 112, with a high degree of stability. The platform 10 is anchored to the workpiece with its projecting fingers. Despite the sturdiness of the fingers, the platform as a whole, the wheels between the platform race and work table and the work table itself, there is the possibility of relative movement between the tools and workpiece which could result in misalignment of the tools with the workpiece. Additional support, or linkage, is desirable between the table and workpiece.

The workpiece, in this embodiment, is the tubesheet 14. It is a conception of the invention to directly link the work table and tubesheet with fingers mounted on the work table and extended directly into tubes 16 of the tubesheet. These fingers can be discerned from FIGS. 1 and 2.

In FIG. 2 finger mechanism 120 is seen mounted on one side of table 100 and finger mechanism 121 is mounted on the opposite side. When one, or both, of the fingers are extended into their respective tubes 16 of tubesheet 14, and locked thereto, work table 100 is given great stability relative to the workpiece.

Fingers 120 and 121, and their actuating mechanism, are fundamentally the same as the fingers mounted on the platform 10. The complications of these mechanisms, and systems for actuating them, will have to be extracted from the disclosure incorporated by reference. These details will not be repeated here. Invention is in the stark provision of the fingers as direct linkage between work table 100 and tubesheet 14. Of course, it should be appreciated that the fingers are controlled to be extended and locked to the workpiece only when a tool on the table is positioned and ready for engagement with the workpiece. Then, before the table is rotated to bring the next tool to the area selected for work, the fingers must be unlocked are retracted to enable the table to be rotated.

FIGS. 3, 4 AND 5

The invention is basically disclosed by FIGS. 1 and 2. FIG. 3 simply shows to better advantage the position of the motor 108 which turns the table and platform relative to each other at the same time. A number of the finger mechanisms are disclosed to show how the platform is basically supported from the workpiece. Additionally, it is made more clear how the wheels 112 are linked between the race of the platform plates and the work table 100.

Figure 4:
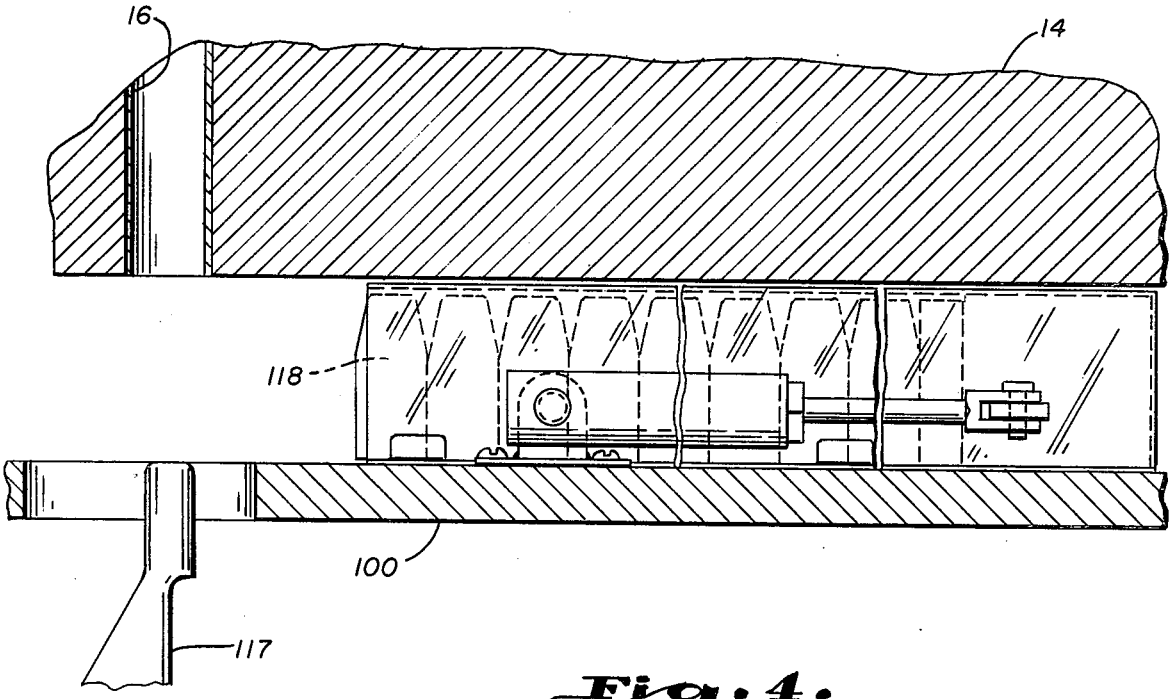
FIG. 4 is a partially sectioned elevation of the weld-head mechanism.

FIG. 4 discloses to some extent how plugs 118 are fed into tubes 16 to be welded into place by the welding tool with head 117. No details of the actual welding mechanisms are disclosed. There is an indication of the presence of the welding machine by partial showing of mandrel 17. Detail disclosure and function of the welding structure are reserved for another patent application to be filed.

Figure 5:
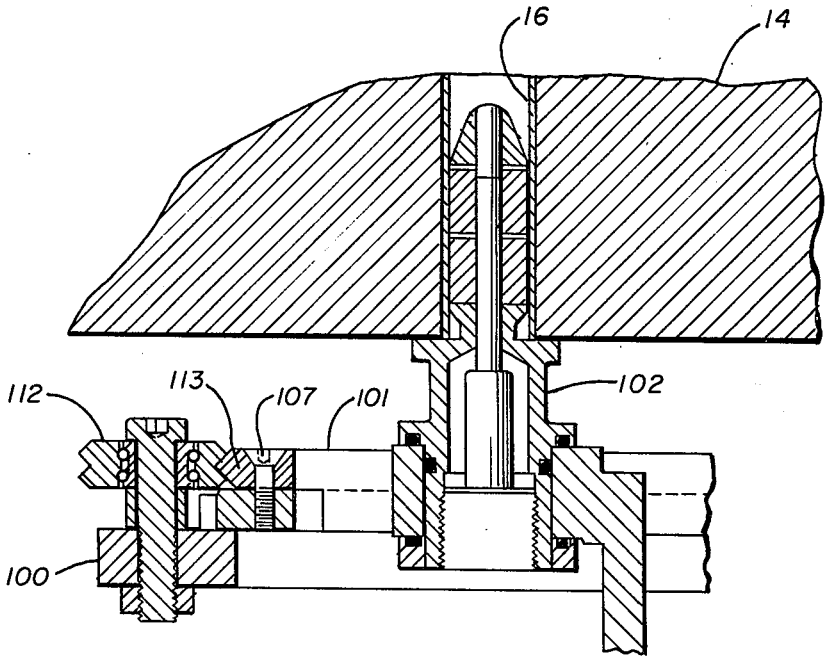
FIG. 5 is a partially sectioned elevation of the rotating mechanism for the table.

FIG. 5 shows a wheel 112 in somewhat greater detail than shown in FIG. 3. Cooperation with the race of plates 101 can again be seen, and finger 102 of the platform is illustrated to structurally relate tubesheet 14 to platform 10 and work table 100.

CLAIM SCOPE REVISITED

In claiming the present invention the platform as a surface traversing apparatus is defined in a way compatible with the patents incorporated by reference. The traversing apparatus is cited as supported by a member whose surface is traversed, that member in the present disclosure being specifically tubesheet 14. The anchor means connected to the base means of the platform, are embodied in the fingers of the present embodiment. The fingers are actuated to move the entire platform in stepwise increments to position the platform relative to a specific tube 16. To all of this surface traversing apparatus, or platform, the claim defines attached circular race with its center in vertical alignment with the geometrical center of the base means of the platform. Then a work table is defined as concentric the race. A plurality of guide wheels is spaced between the race and table. A motor means is connected between the race and table to move the table about the race. Finally, tools are mounted on the work table and rotated to positions on the surface of the member-tubesheet to carry out their work.

A definition of the motor means specifies that a pinion gear is mounted on the motor to engage the ring gear on the circular race to form the linkage through which the table is positioned about the race.

Further, at least one anchor means, or finger, is defined as mounted on the work table so that it may be selectively engaged with the member-tubesheet to resist lateral motions by the work table while each tool is operated from the work table.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention, having been described, what is claimed is:

1. In a surface traversing apparatus adapted to be supported near a member for traversing the surface of the member by stepwise motion, the surface traversing apparatus including base means, first and second anchor means each movably connected to the base means for stepwise lateral relative motion in different respective directions, the first and second anchor means being selectively engageable with the member for resisting lateral motion relative thereto, first and second actuating means operatively connected to the first and second anchor means respectively and to the base means for moving the respective first and second anchor means laterally relative to one another in discrete steps, means to alternately engage the first and second anchor means with the member while the other of the anchor means is disengaged from the member so as to transport the first and second anchor means laterally relative to the other of the anchor means by the first or second actuating means respectively to move the first and second anchor means to new relative positions, the improvement wherein, a circular race is mounted on the base means with its center in substantial vertical alignment with the geometrical center of the base means, a work table in the form of a circular flange and positioned concentric the race, a plurality of guide wheels spaced at fixed positions between the race and table so as to enable the table to rotate relative the race in a plane parallel the surface of the member, motor means connected between the race and table to rotate the table to selected positions relative to the surface traversed by the base, and tools mounted at stations on the work table, whereby each tool is positioned in a desired sequence over the same location on the surface of the member to carry out work on the same surface structure.

2. The apparatus of claim 1 in which, the motor means includes, a gear motor connected to the work table, a pinion gear mounted on the gear motor, and a ring gear formed on the circular race and engaged by the pinion to form the link with which the table is positioned about the race.

3. The apparatus of claim 2 including, at least one anchor means mounted on the work table and actuated to be selectively engageable with the member for resisting lateral motion of the work table relative thereto during the work of each tool at the same location on the surface of the member.

* * * * *